US006880525B2

(12) United States Patent
Geyer et al.

(10) Patent No.: US 6,880,525 B2
(45) Date of Patent: Apr. 19, 2005

(54) IGNITION CIRCUIT HAVING RPM LIMITATION FOR AN INTERNAL COMBUSTION ENGINE

(75) Inventors: Klaus Geyer, Sulzbach (DE); Eberhard Schieber, Backnang (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 10/852,165

(22) Filed: May 25, 2004

(65) Prior Publication Data

US 2004/0237933 A1 Dec. 2, 2004

(30) Foreign Application Priority Data

May 26, 2003 (DE) ..... 103 23 558

(51) Int. Cl.[7] ..... F02P 5/00
(52) U.S. Cl. ..... 123/406.18
(58) Field of Search ..... 123/65 R, 406.12, 123/406.18, 406.24, 406.34, 406.58

(56) References Cited

U.S. PATENT DOCUMENTS 4,979,477 A 12/1990 Nickel et al.

*Primary Examiner*—Bibhu Mohanty
(74) *Attorney, Agent, or Firm*—Walter Ottesen

(57) ABSTRACT

The invention is directed to an ignition circuit for a two-stroke engine in a portable handheld work apparatus. A spark plug (2) is connected via a switch (14) to a voltage source (16). The ignition switch (14) is actuated by an electronic control circuit (15) which closes the ignition switch (14) in dependence upon the crankshaft angle and additional operating parameters such as the rpm of the engine (1) in order to trigger an ignition spark per revolution of the crankshaft (10). To limit rpm, the ignition switch (14) is held open when a pregiven end rpm is exceeded in order to suppress an ignition spark over at least one crankshaft revolution. In order to prevent that additional vibrations are excited by the limiting of rpm, the ignition switch (14) is closed after an end rpm is exceeded in accordance with the random principle and in dependence upon the position of the crankshaft (10) in such a manner that an ignition spark, which corresponds to a crankshaft revolution, is triggered in accordance with the random principle.

8 Claims, 1 Drawing Sheet

IGNITION CIRCUIT HAVING RPM LIMITATION FOR AN INTERNAL COMBUSTION ENGINE

CROSS REFERENCE TO RELATED APPLICATION

This application claims priority of German patent application no. 103 23 558.2, filed May 26, 2003, the entire content of which is incorporated herein by reference.

FIELD OF THE INVENTION

The invention relates to an ignition circuit for an internal combustion engine, especially for a two-stroke engine in a handheld portable work apparatus including a motor-driven chain saw, a brushcutter, a cutoff machine or the like.

BACKGROUND OF THE INVENTION

An ignition circuit of the above kind is disclosed, for example, in U.S. Pat. No. 4,979,477. A spark plug is connected to a voltage source via an electronic switch. The ignition switch is actuated by a control circuit which closes the switch per revolution of the crankshaft in dependence upon the crankshaft angle and additional operating parameters such as the rpm of the engine and triggers an ignition spark. If the rpm exceeds a pregiven limit rpm, the control circuit holds the switch open and suppresses the ignition spark over at least one crankshaft revolution. This leads to a drop in rpm so that the rpm cannot increase beyond a permissible maximum rpm.

The known ignition switch makes possible a precise limiting of rpm whereby damage because of excessive rpm can be reliably avoided. However, depending upon the displacement of the engine and the apparatus driven by the engine, ignition uniformities have been determined in practice whereby inherent oscillations or vibrations can be excited. These can lead to an increased vibration at the handles of the portable handheld work apparatus.

SUMMARY OF THE INVENTION

It is an object of the invention to provide an ignition circuit having rpm limiting which is so configured that vibration excitations of the total system are avoided.

The ignition circuit of the invention is for an internal combustion engine including a two-stroke engine in a portable handheld tool with the engine having a crankshaft. The ignition circuit includes: a spark plug; a voltage source; an ignition switch connecting the spark plug to the voltage source; a control circuit for actuating the ignition switch and the control circuit closing the ignition switch in dependence upon the angular position of the crankshaft and other parameters of the engine to trigger an ignition spark per revolution of the crankshaft; and, the control circuit including means for closing the ignition switch after a limit rpm of the engine is exceeded with the closing above the limit rpm being in accordance with a random principle and in dependence upon the position of the crankshaft so as to cause an ignition spark, which corresponds to the crankshaft revolution, to be triggered in accordance with the random principle.

According to the invention, the ignition switch is not simply held open after a limit rpm is exceeded, rather, the ignition switch is actuated in accordance with a random principle in such a manner that an ignition spark, which corresponds to the crankshaft revolution, is triggered randomly after the n-th crankshaft revolution.

It has been surprisingly shown that a uniformity of the ignition sequence is reliably prevented via such a random ignition after an ignition suppression during the operating state of rpm limiting whereby an excitation of inherent vibrations is prevented.

The triggering of a random ignition spark has been shown to be practical approximately every one to six crankshaft revolutions. The last bit of a digital counter of the control circuit can be utilized as a random generator.

Advantageously, after reaching a limit rpm (intervention rpm), the ignition is switched over to an ignition in accordance with the random principle in order to limit rpm so that the ignition takes place exclusively in accordance with the random principle in an rpm range between the limit rpm (intervention rpm) and an end rpm. When exceeding the end rpm, the ignition is switched off as previously so that a maximum rpm is reliably not exceeded. The rpm range between the limit rpm (intervention rpm) and the end rpm, which lies below the maximum rpm, lies in a range from approximately 50 to 600 rpm, preferably between 150 to 450 rpm and especially at approximately 350 rpm.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
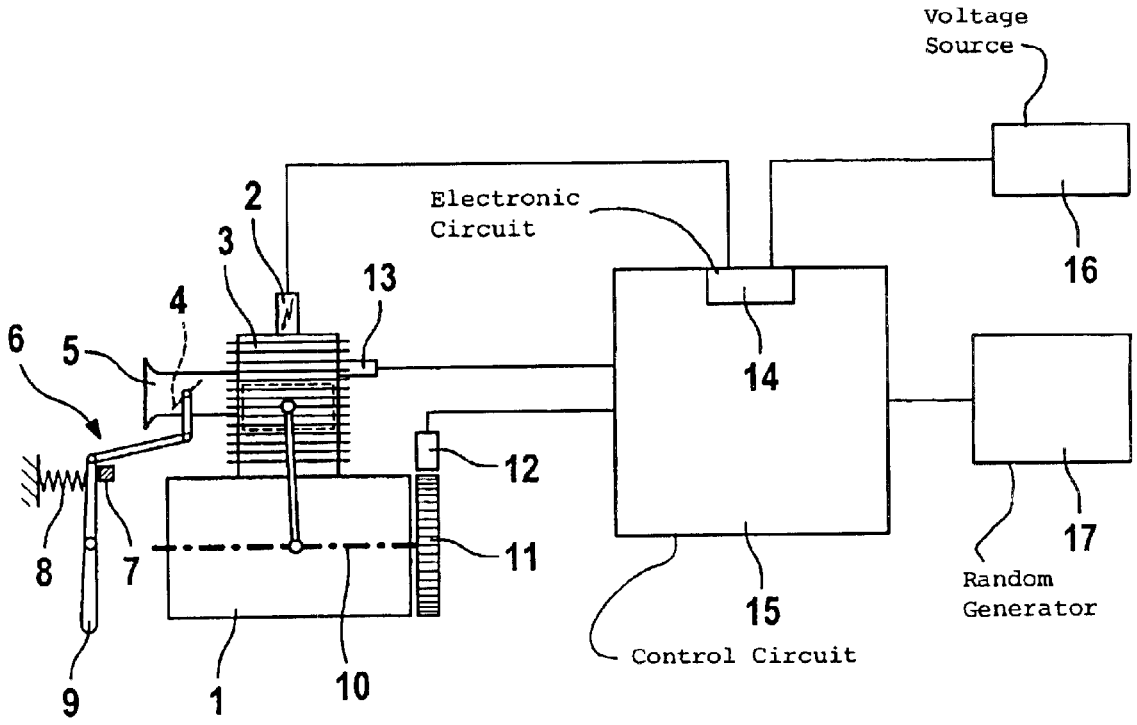
FIG. 1 shows a schematic of an ignition circuit according to the invention in a two-stroke engine; and, FIG. 2 is a diagram showing the course of the rpm.

The ignition circuit shown schematically in FIG. 1 is provided on a two-stroke engine 1 which is, for example, mounted in a portable handheld work apparatus such as a motor-driven chain saw, brushcutter, cutoff machine or the like. The ignition circuit of the invention is basically also usable in other air-cooled or water-cooled internal combustion engines.

The air-cooled cylinder 3 in the embodiment shown has an intake stub 5 with a carburetor and a throttle flap 4. The throttle flap 4 is actuable by a throttle lever 9 via a linkage 6 in order to change the engine rpm. In the idle position shown, the throttle lever 9 lies against a stop 7 under the action of a spring 8.

A reciprocating piston is provided in the cylinder 3 which drives a crankshaft 10 via a connecting rod. A pulse transducer wheel 11 runs with the crankshaft 10. The marks of the pulse transducer wheel, which are provided on the periphery thereof, generate pulses in an assigned sensor 12 which are supplied to the control circuit 15 as rpm data signals. The marks on the pulse transducer wheel 11 are so arranged that at least per crankshaft revolution, one signal, which is specific to the crankshaft position, is generated from which the control circuit 15 can recognize the instantaneous rotational position of the crankshaft 10. Preferably, the marks are arranged over the periphery of the pulse transducer wheel 11 at different distances so that the angular position of the crankshaft 10 can be detected directly from the spacing of the pulses of the sensor 12.

The control circuit, which is configured as an electronic circuit, is preferably a microprocessor which processes the signals of the pulse sensor 12 and correspondingly controls an electronic circuit 14 which connects a spark plug 2 to a voltage source 16 for generating an ignition spark outputted in the combustion chamber. The spark plug 2 is arranged on the cylinder 3 of the engine 1. It can be advantageous to announce additional operating parameters of the engine to the control circuit 15 such as the cylinder temperature. For this purpose, a temperature sensor 13, which is mounted on the cylinder 3, can be provided.

The microprocessor functions in accordance with a pregiven sequence diagram. A plurality of operating parameters of the engine 1 can be processed for determining the ignition time point. The microprocessor or the control circuit 15 simultaneously limits the maximum rpm of the engine by suppressing an ignition spark after an end rpm is exceeded.

If the engine is not to exceed a pregiven maximum rpm of, for example, 9,400 rpm, then the ignition is switched off starting at an end rpm of, for example, 9,100 rpm. To avoid ignition uniformities, the control circuit of the invention intervenes at a limit rpm which lies approximately 300 to 400 rpm below the end rpm. This limit rpm can also be referred to as intervention rpm and can lie in a range between 50 and 600 rpm below the end rpm, preferably in a range of 150 to 450 rpm.

If the control circuit 15 or the microprocessor arranged therein determines that the limit rpm (intervention rpm) is exceeded, then the ignition, which is provided per crankshaft revolution, is switched off and is switched over to an ignition mode in accordance with a random principle. For this purpose, a random generator 17 is provided which triggers ignition sparks randomly within the rpm range D. In this way, an ignition spark is triggered randomly approximately every one to six crankshaft revolutions. A digital counter can be used as a random generator as it is utilized, for example, in the control circuit 15 for processing the pulses supplied by the sensor 12. In a counter of this kind, the digital number of the smallest position can be, for example, used as a random generator and an ignition spark is always triggered when, at the time point of the inquiry, for example, the number "1" is shown. If the number "0" is shown, the ignition spark is suppressed. The ignition can be triggered alternatively and/or additionally also when there is a drop below the intervention rpm.

Figure 2:
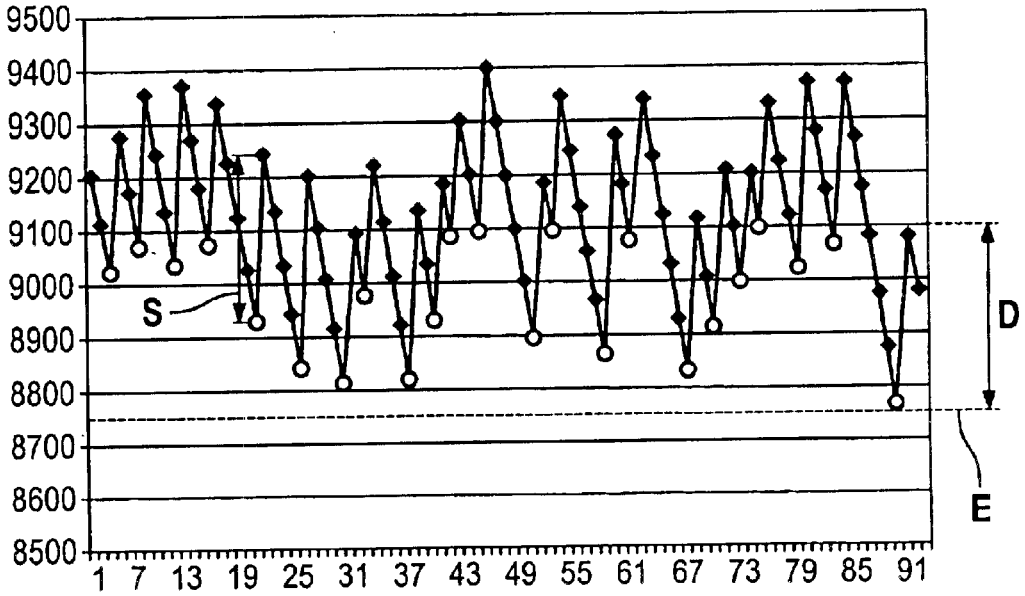

As soon as the rpm of the engine 1 has therefore exceeded the limit rpm (intervention rpm), a non-uniform ignition takes place whereby an rpm course results which is shown in FIG. 2 as a function of the number of continuous rpm revolutions.

In the diagram, the rpm is detected per crankshaft revolution. The intervention rpm E lies at 8,750 rpm and the end rpm lies at, for example, 9,100 rpm and the maximum rpm lies at 9,400 rpm. As FIG. 2 shows, exceeding the end rpm is permitted in the control of the invention. However, an ignition in accordance with the random principle is only carried out in the rpm range D between the intervention rpm E and the end rpm of 9,100 rpm. The ignitions are shown in the diagram by the clear points and lie, without exception, in the rpm range D.

As shown by the course of the diagram in FIG. 2, a different rpm increase can be seen after each random ignition. This is dependent upon the charge of the combustion chamber with a fresh mixture. The charge is that much better the more exchanges of charge have taken place, that is, crankshaft revolutions without ignition. An rpm jump S of, for example, 200 to 400 rpm is therefore possible in dependence upon the configuration and size of the engine. Smaller or larger rpm jumps can occur. The rpm jump S shown of approximately 300 revolutions per minute was reached after an absence of ignition in four previous crankshaft revolutions and only in the fifth crankshaft revolution did the ignition take place in accordance with the random principle.

As the diagram shows, in the embodiment, at least two crankshaft revolutions without ignition and up to six crankshaft revolutions without ignition lie between sequential ignitions (right hand portion of diagram). When the end rpm of 9,100 rpm is exceeded, the ignition is completely suppressed so that increase of the engine rpm above the maximum rpm of 9,400 rpm is reliably prevented.

The ignition shown in FIG. 1 functions in three stages. Below the intervention rpm E, the ignition takes place in a manner known per se in accordance with an ignition characteristic field, ignition algorithm or the like. In the region between the intervention rpm E and the end rpm of 9,100 rpm (that is, in the rpm range D), the ignition takes place in accordance with the random principle. A random ignition spark is triggered approximately every one to six crankshaft revolutions so that the engine speed (rpm) stays essentially above the intervention rpm E. The ignition is switched off above the end rpm of 9,100 rpm so that an rpm increase above the highest rpm of approximately 9,400 rpm is reliably avoided.

It is understood that the foregoing description is that of the preferred embodiments of the invention and that various changes and modifications may be made thereto without departing from the spirit and scope of the invention as defined in the appended claims.

What is claimed is:

1. An ignition circuit for an internal combustion engine including a two-stroke engine in a portable handheld tool, the engine having a crankshaft and the ignition circuit comprising:

a spark plug;

a voltage source;

an ignition switch connecting said spark plug to said voltage source;

a control circuit for actuating said ignition switch and said control circuit closing said ignition switch in dependence upon the angular position of said crankshaft and other parameters of said engine to trigger an ignition spark per revolution of said crankshaft; and, said control circuit including means for closing said ignition switch after a limit rpm of said engine is exceeded with said closing above said limit rpm being in accordance with a random principle and in dependence upon the position of said crankshaft so as to cause an ignition spark, which corresponds to the crankshaft revolution, to be triggered in accordance with said random principle.

2. The ignition circuit of claim 1, said control circuit including means for limiting the rpm of said engine when the rpm of said engine exceeds a predetermined end rpm by holding said ignition switch open in order to suppress an ignition spark over at least one revolution of said crankshaft whereby a maximum rpm of said engine is not exceeded.

3. The ignition circuit of claim 2, wherein a random ignition spark is triggered approximately every one to six crankshaft revolutions.

4. The ignition circuit of claim 3, wherein said ignition takes place in accordance with the random principle in a range (D) between said limit rpm and said end rpm.

5. The ignition circuit of claim 4, wherein said range (D) has a width of approximately 50 to 600 rpm.

6. The ignition circuit of claim 4, wherein said range (D) has a width of 150 to 450 rpm.

7. The ignition circuit of claim 1, wherein said means for closing said ignition switch after said limit rpm is exceeded comprises a random generator.

8. The ignition circuit of claim 7, wherein said random generator is a digital counter.

* * * * *